US005221246A

United States Patent [19]

Torii

[11] Patent Number: 5,221,246

[45] Date of Patent: Jun. 22, 1993

[54] APPARATUS FOR SUPPORTING A USER IN AN INVERTED POSITION

[75] Inventor: Masakatsu Torii, Tokyo, Japan

[73] Assignee: Saitama Kako Kabushiki Kaisha, Hatogaya, Japan

[21] Appl. No.: 980,198

[22] Filed: Nov. 20, 1992

[30] Foreign Application Priority Data

Jan. 28, 1992 [JP] Japan ..... 4-008166[U]

[51] Int. Cl.[5] ..... A63B 26/00

[52] U.S. Cl. ..... 482/144; 482/121; 482/128

[58] Field of Search ..... 482/142, 144, 23, 33, 482/34, 35-36, 38, 92, 93, 121-123, 128, 133, 142-144, 907

[56] References Cited

U.S. PATENT DOCUMENTS

| | | | |
|---|---|---|---|
| 2,223,309 | 11/1940 | Swanson | 482/123 |
| 2,919,918 | 1/1960 | Horn | 482/142 |
| 3,114,545 | 12/1963 | Horn | 482/142 |
| 3,857,561 | 12/1974 | Cechettini | 482/142 |
| 4,337,942 | 7/1982 | Sidlinger et al. | 482/142 |
| 4,503,845 | 3/1985 | Licciardi . | |

FOREIGN PATENT DOCUMENTS 2724452 12/1978 Fed. Rep. of Germany ..... 482/144

*Primary Examiner*—Richard J. Apley
*Assistant Examiner*—Jerome Donnelly
*Attorney, Agent, or Firm*—M. Reid Russell

[57] ABSTRACT

Apparatus for supporting a user in an inverted position supported on their shoulder that includes foot members, an abdomen rest member, a support member, a pair of shoulder rest members that are disposed between the abdomen rest member and support member, and a pair of grip members that are disposed below the shoulder members. To use the apparatus, a user first bends their abdominal region over the abdomen rest member, positioning their shoulders above the shoulder rest members and grasps the grip members with their hands. They then rest their shoulders onto the shoulder rest members with their head fitted between which shoulder rest members. The user then pivots their hips and knees away from the abdomen rest member, straightening their legs, that engage the support member, at the backs of the legs or their hips, the support member supporting their legs in an inverted position. The user lowers their abdomen back onto the abdomen rest member and lowers their feet to the surface to return to a standing attitude.

7 Claims, 8 Drawing Sheets

APPARATUS FOR SUPPORTING A USER IN AN INVERTED POSITION

BACKGROUND OF THE INVENTION

1. Field of the Invention

The present invention relates to an apparatus for promoting users' health and more particularly to an apparatus for supporting a user in an inverted position supported on their shoulders.

2. Prior Art

It has been found beneficial for health for a person to be in an inverted position for a limited period of time. Such practice tends to correct downward displacement of their internal organs and provides increased blood flow to their brain. Such practice, however, is not easy for many people, especially for persons who are elderly or less physically adept. Remaining in an inverted attitude, as by a person standing on their hands, without assistance is difficult for any person, and includes a risk to the person of their falling, resulting in injury.

Accordingly, various apparatus have been developed to support a user in an inverted position. Some such devices have involved inversion boots that are worn by a person to allow them to hang by their feet from a bar, or have involved an inversion platform or bed to which the legs of a person are maintained, with the platform or bed rotated so as to turn the person to an inverted position. These types of apparatus, particularly the inversion bed or platform, are generally large units. Also, in using such inversion devices the persons head will be swung in a circular arc with a great radius, potentially causing the user to feel sick, similar to being airsick, seasick, or carsick.

Distinct from the above described inversion devices, a U.S. Pat. No. 4,503,845 discloses an apparatus that provides for supporting a person in an inverted position with their knees bent. Such positioning diminishes the positive effect on the persons systems and blood flow to the person's brain that is achieved when their body is straight, and also causes the person to feel somewhat cramped. With the device of the '845 patent, the user is maintained in an inverted position with their thighs supported by a thigh support and the soles of their feet braced against a foot support bar, providing a somewhat unstable support. Whereas, the person using the device of the invention is supported at their shoulders. Structurally, of course, the device of the invention is unlike an inversion device or the support apparatus of the '845 patent.

SUMMARY OF THE INVENTION

Accordingly, it is an object of the present invention to provide an apparatus for supporting a user in an inverted position which overcomes the aforementioned problems.

It is a particular object of the present invention to provide an apparatus for supporting a user in an inverted position that is safe and easy to use without requiring that the user have great strength or agility, and thereby can be used by elderly and less physically adept people.

It is another object of the present invention to provide an apparatus for supporting a user in an inverted position that will securely support that user.

It is yet another object of the present invention to provide a compact apparatus for supporting a user in an inverted position.

It is still another object of the present invention to provide an apparatus for supporting a user in an inverted position that will not create a condition where that user will be subject to sickness that is similar to airsickness, carsickness or seasickness.

It is a further object of the present invention to provide an apparatus for supporting a user in an inverted position that supports the user with their legs fully extended.

It is a still further object of the present invention to provide an apparatus where a user is supported in an inverted position.

It is yet a further object of the present invention to provide an apparatus that, with some reconfiguration, can be used as a chair.

In accordance with the above objects, the present invention is in an apparatus for maintaining a user who is supported at their shoulders in an inverted position. The apparatus includes a frame that incorporates floor supports or foot members with upright members extending therefrom that attach to a pair of spaced apart flat shoulder rest members. The shoulder rest members support a user who rests their shoulders thereon with their head inserted between the shoulder rest members. An abdomen rest member extends from the floor supports to be disposed behind the shoulder rest members relative to a user utilizing apparatus and is to receive a user's abdomen region positioned there against with their shoulders resting on the top surfaces of the shoulder members. A support member is mounted to extend upwardly from the floor supports, forward of the abdomen rest member and the shoulder rest members. Which support member, with the user in an inverted attitude, receives the user's buttocks or the back of their legs, depending upon their height, leaned thereagainst, with the user's shoulders resting on the shoulder rest members, after the user has pushed off their abdomen region from the abdomen rest member.

More particularly, to the present invention, the abdomen rest member includes a horizontal pipe that extends horizontally across the frame, and a cylindrical abdomen cushion member axially mounted thereto that is free to rotate. Additionally, the abdomen rest member may be vertically movable relative to the ground, and bias means, such as a spring arrangement, may be utilized for upwardly biasing the abdomen rest member.

BRIEF DESCRIPTION OF THE DRAWINGS

The foregoing and other objects, features and advantages of the present invention will become apparent from the following detailed description taken in connection with the accompanying drawings, which drawings it should be understood are for the purpose of illustration only and are not intended as defining the limits of the invention.

DETAILED DESCRIPTION

Figure 1:
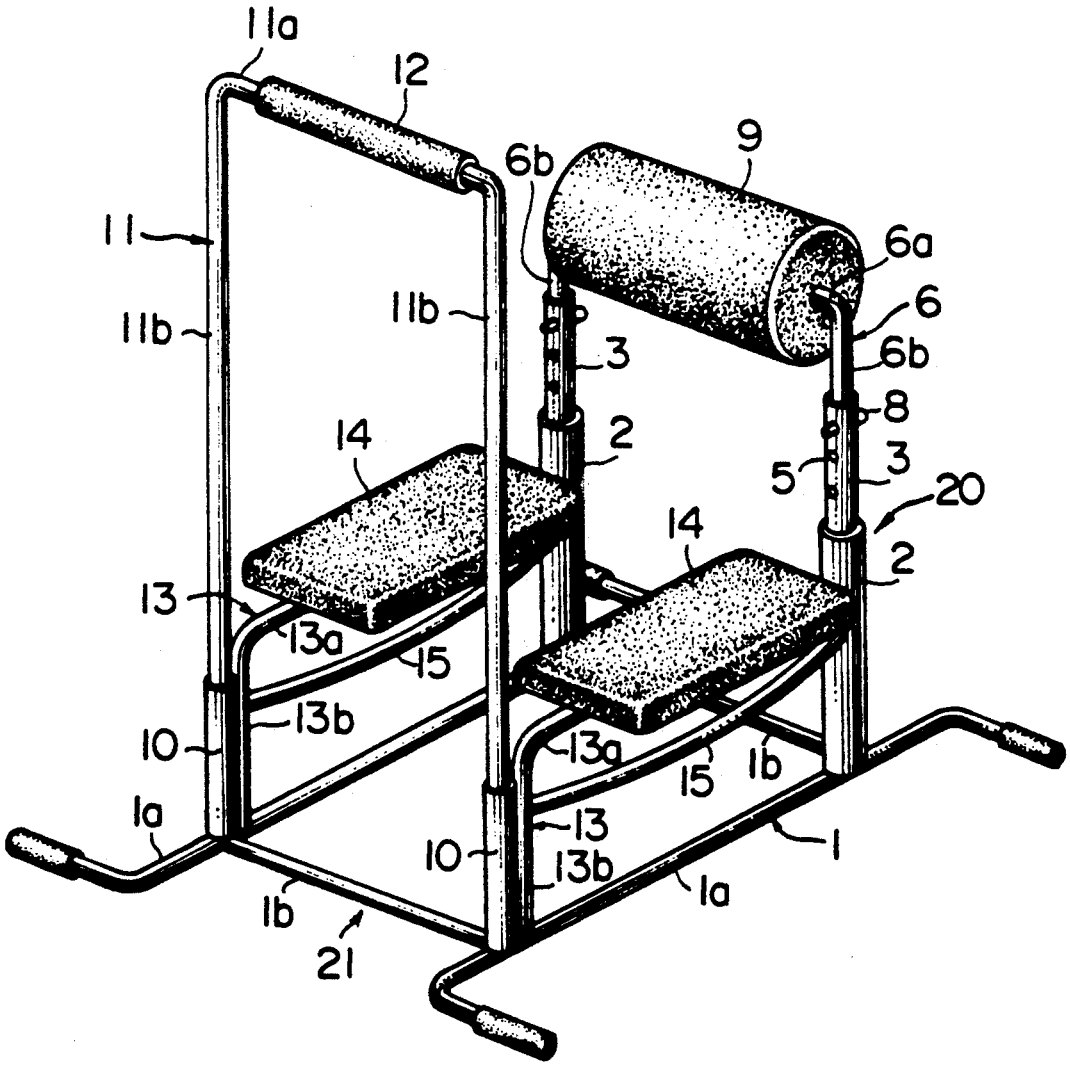
FIG. 1 is a front elevation perspective view of an apparatus for supporting a user in an inverted position in accordance with one embodiment of the present invention.
Figure 2:
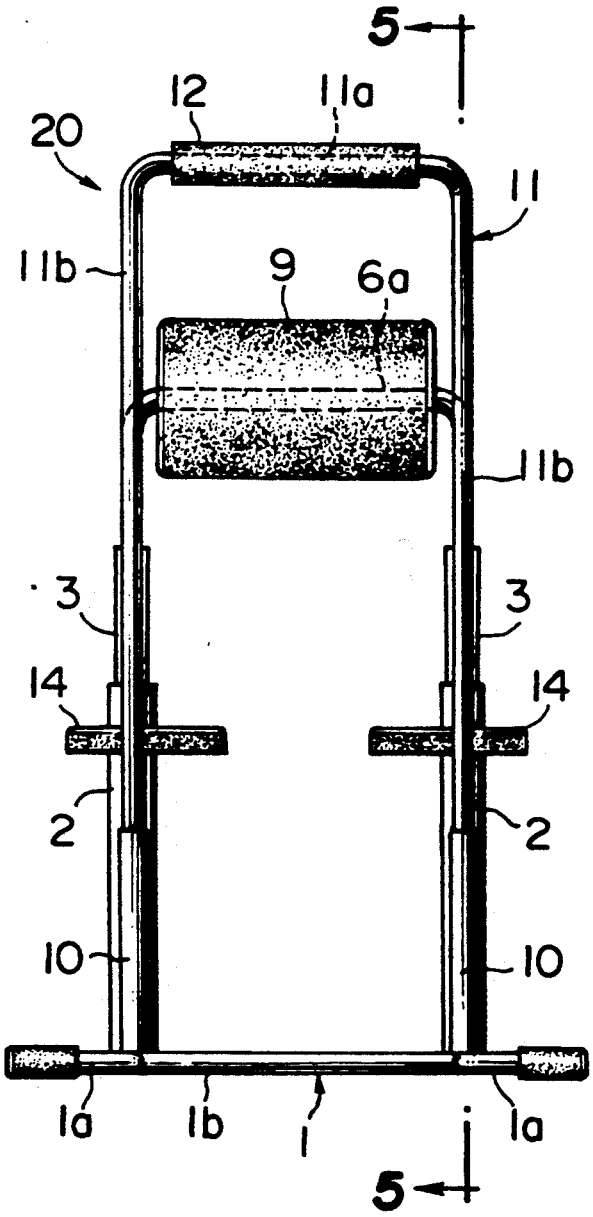
FIG. 2 is a front elevation view of the apparatus of FIG. 1
Figure 3:
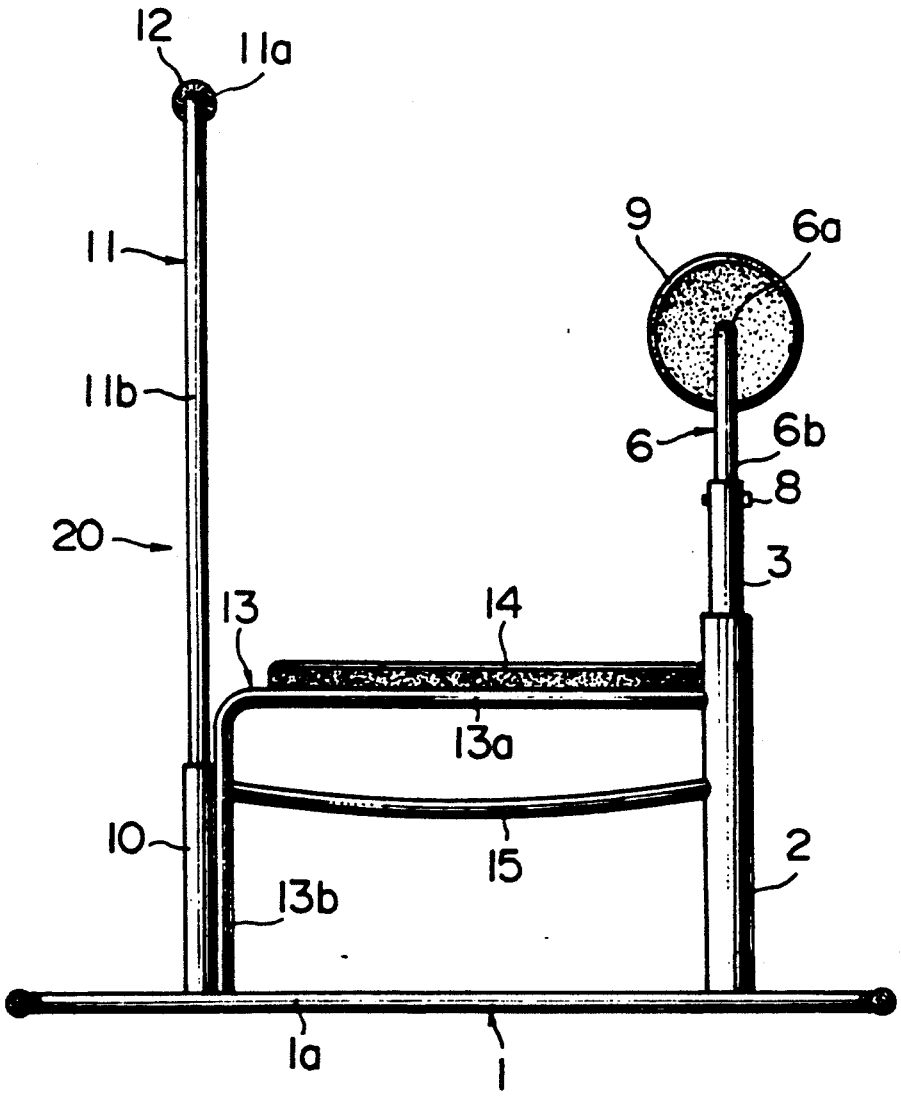
FIG. 3 is a side elevation view of the apparatus of FIG. 1.
Figure 4:
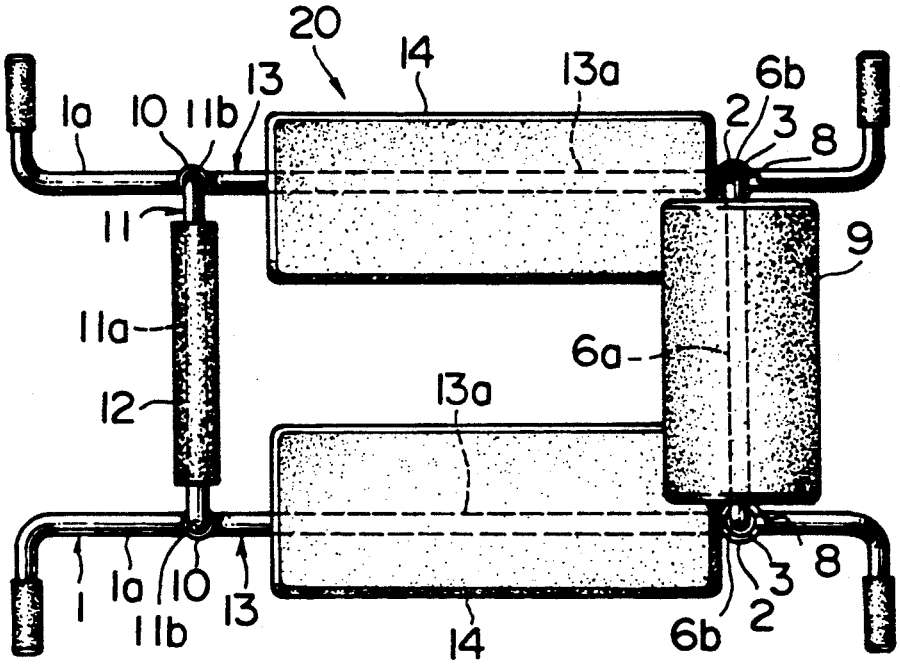
FIG. 4 is a top plan view of the apparatus of FIG. 1

The present invention will hereafter be described in conjunction with one preferred embodiment that is shown in the drawings.

Shown in the figures, the apparatus for supporting a user in an inverted position 20, hereinafter referred to as apparatus, includes as a frame 21 that includes foot members 1 as ground supports that are right and left pipes 1*a*, and are preferably steel pipes, that are bent outwardly into parallel ends. The foot members 1 are disposed parallel to each other with a pair of identical straight pipes 1*b*, that are also preferably steel pipes, connected between the pipes 1*a*, proximate to their bends, forming a rectangular shape. Right and left upright vertical support cylinders 2 are provided as components of frame 21 that are secured at right angles upwardly from the pipes 1*a* near a rear end of each. Front and rear being respective to a person approaching to use the apparatus 20. Right and left vertical movable columns 3, that are preferably formed from steel pipes, are provided that each include a closed lower end, that is individually fitted into the support cylinders 2, so as to be vertically movable relative to which support cylinders 2. As shown best in FIG. 5, coil springs 4 are interposed between respective bottoms of support cylinders 2 and lower ends of movable columns 3 to bias the movable columns 3 upwardly. Each movable column 3 is further provided with a plurality of transverse height adjusting holes 5 that are formed at space points along each column longitudinal axis.

An abdomen rest member 6 is provided as part of frame 21, that is preferably formed of steel pipe and consists of parallel right and left vertical upright sections 6*b* with a horizontal member 6*a* extending between the upper ends of which vertical sections 6*b*. The lower ends of the vertical sections 6*b* are each fitted into open upper ends of movable columns 3 to telescope up and down therein. Shown in FIGS. 5 and 6, pin holes 7 are formed at spaced vertical points along the lower ends of horizontal sections 6*b* of the abdomen rest member 6. The height of the abdomen rest member 6 relative to the movable column 3 can thereby be adjusted by aligning a pin hole 7 with one of the height adjusting holes 5 and fitting pin 8 therein. A cylindrical abdomen cushion member 9, that is preferably formed of a cushioning material such as a sponge foam to have a diameter of 200 to 250 mm, is axially mounted onto the horizontal member 6*a*, to be rotatable about the section longitudinal axis.

Figure 7:
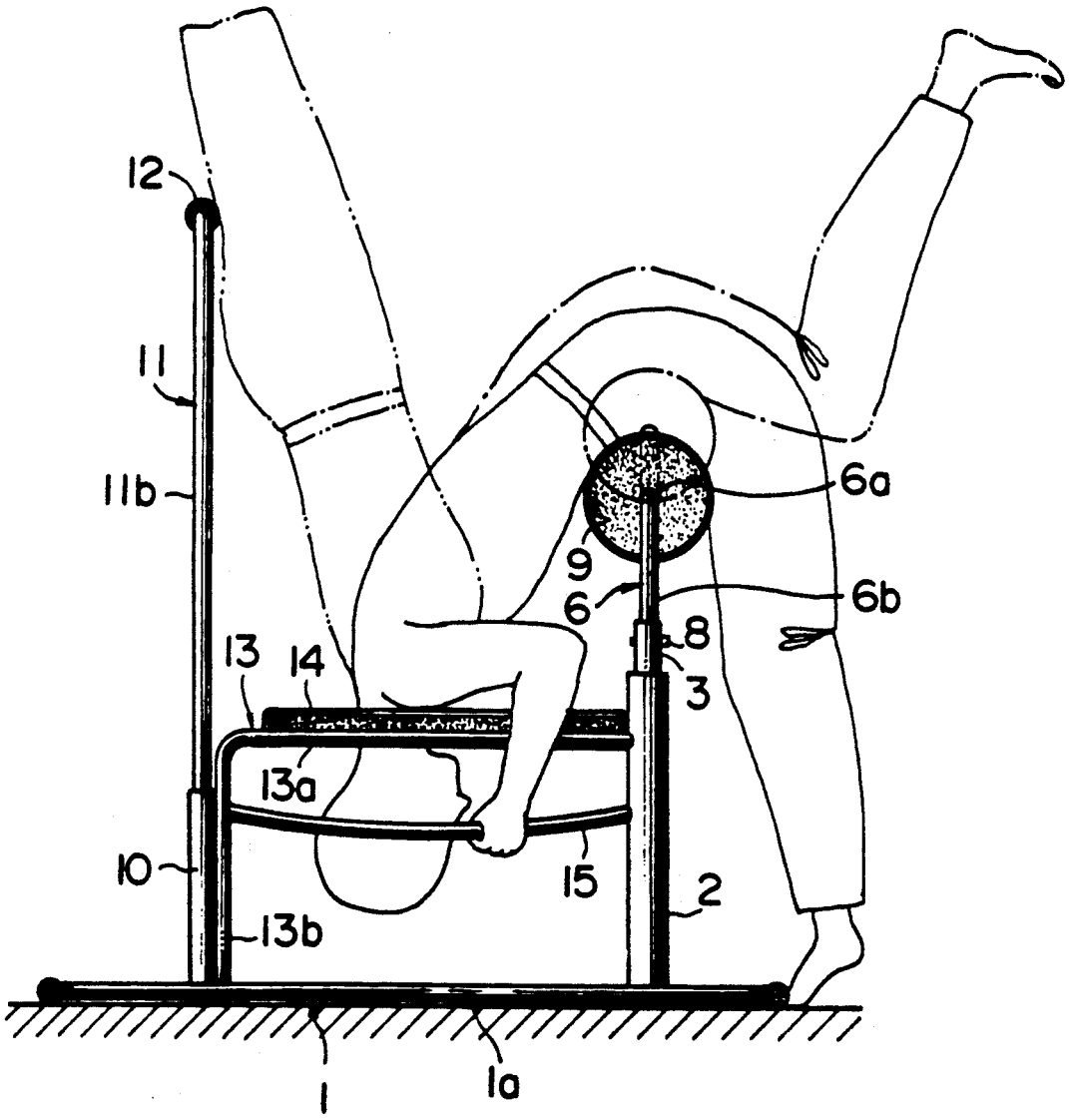
FIG. 7 is a side elevation view of the apparatus of FIG. 1 showing a user in broken lines for illustrating a method by which the user may use the apparatus.

Right and left vertical support tubes 10 are provided as components of frame 21 to extend at right angles upward from the right and left pipes 1*a* from the forward end thereof relative to a person leaning over the cushion member 9, as shown in FIG. 7. A support member 11 that is preferably fabricated from steel pipe, is shown to include right and left vertical portions 11*b* with a horizontal portion 11*a* extending between the upper ends of which vertical portions 11*b*, and is for mounting to the support tubes 10. In that mounting the lower ends of vertical portions 11*b* are each telescoped into be easily removable from the support pipes 10. A layer 12 of cushion material is preferably wrapped around the horizontal portion 11*a*.

Right and left shoulder support members 13 are provided as parts of frame 21 that are each preferably steel pipes and have each been bent into an "L" shape. Each support member, as shown, consists of a horizontal portion 13*a* and a vertical portion 13*b*, respectively. The horizontal portions 13*a* of shoulder support members 13 ends are each connected, as by welding, to the side of a support pipes 2, forming approximately a right and thereto. With the other ends of each vertical portion 13*b*, in turn, connected at intermediate points along pipes 1*a*, respectively, and extend upwardly at approximately right angles therefrom. Right and left plate-like shoulder rest support members 14, that each have at least a layer cushioning arranged across a top surface thereof, are individually mounted onto the horizontal portions 13*a* of shoulder support members 13, respectively, to extend thereacross in a horizontal plane, with a space between. Below each shoulder rest member 14, is arranged a slightly curved hand grip member 15. Each grip member is preferably formed from a steel pipe that is connected into the sides of each support pipes 2 and a vertical portion 13*b* of shoulder support members 13, respectively, and are for manual gripping by a person utilizing the apparatus 20.

Figure 5:
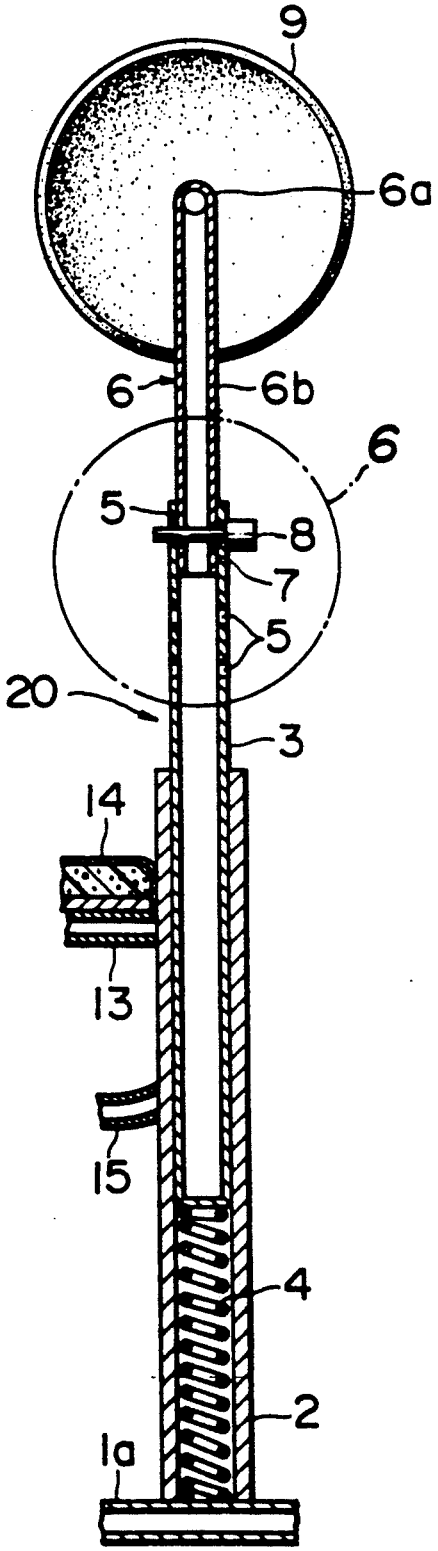
FIG. 5 is a sectional view of a rear part of the apparatus of FIG. 1 taken along the line 5—5 of FIG. 2.
Figure 6:
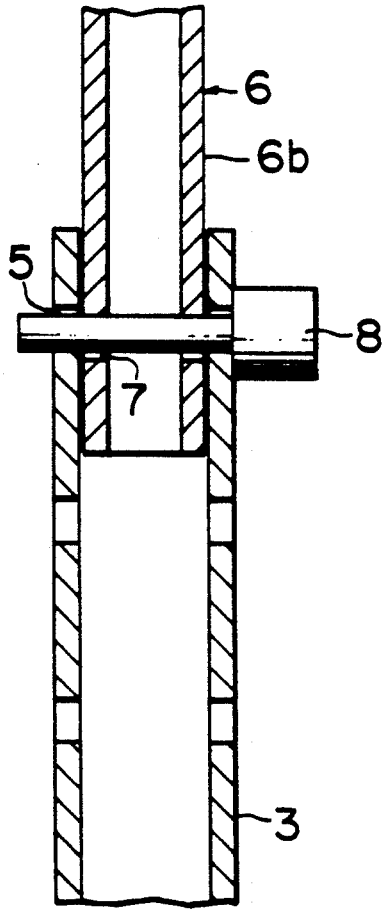
FIG. 6 is an expanded sectional view showing a joint structure of a movable column and an abdomen rest member of the apparatus of FIG. 1 taken within the circle 6 of FIG. 5.

To use the apparatus 20, as illustrated in FIG. 7, a user, shown in the broken lines, bends over and rests their abdominal region, preferably at his belt line or somewhat below, onto the abdomen cushion member 9 that is axially maintained to turn on horizontal member 6*a* of abdomen rest member 6. The user then grasps grip members 15 with their hands, and rests their shoulders on the shoulder rest members 14. So arranged, the user's head is fitted between the shoulder rest members, with the angle between their shoulders and the shoulder rest members 14 to be as close as possible to ninety (90) degrees. In this attitude, the coil springs 4, shown in FIG. 5, are compressed by the weight of user, lowering the movable columns 3 and the abdomen support 6, so as to allow the user to easily bend himself over the abdomen cushion member 9. The resiliency of the springs 4 as well as the cushioning effect of abdomen cushion member 9 alleviates any oppressive sensation to the user's abdomen. Further, as the abdomen cushion 9 is rotatable around the horizontal member 6*a* of abdomen rest member 6, the user can readily perform the aforesaid action.

Next, the user raises their feet from the floor, and shifts their weight off their feet. The coil springs 4 urges the abdomen support 6 and abdomen cushion member 9 upwardly, the movable columns 3 and abdomen support member 6 supporting the user in a semi-inverted position, as shown by the broken lines in FIG. 7.

The user then stretches their hips and knees upwardly and straightens their legs to the vertical, as shown in broken lines in FIG. 7. The user in lifting their legs to the vertical moves the back side of their legs or hips into contact with the cushion layer 12 that is wrapped around horizontal portion 11*a* of the support member 11, which horizontal portion 11*a* restricts the user's legs from movement past the vertical. The user is thereby supported in an inverted position by the apparatus 20 with the shoulders resting on the shoulder rest members 14, and the back side of their legs or hips resting against the cushion layer that is wrapped around the horizontal portion 11*a* of support member 11, and with the user's knees and hips in an extended attitude.

In order to dismount from the apparatus 20, the user essentially reverses the steps heretofore outlined. In which dismount, even should the user lower their abdomen rapidly to the abdomen cushion 9, the coil springs 4 and the abdomen cushion member 9 will cushion the descent and assure a controlled dismount.

Figure 8:
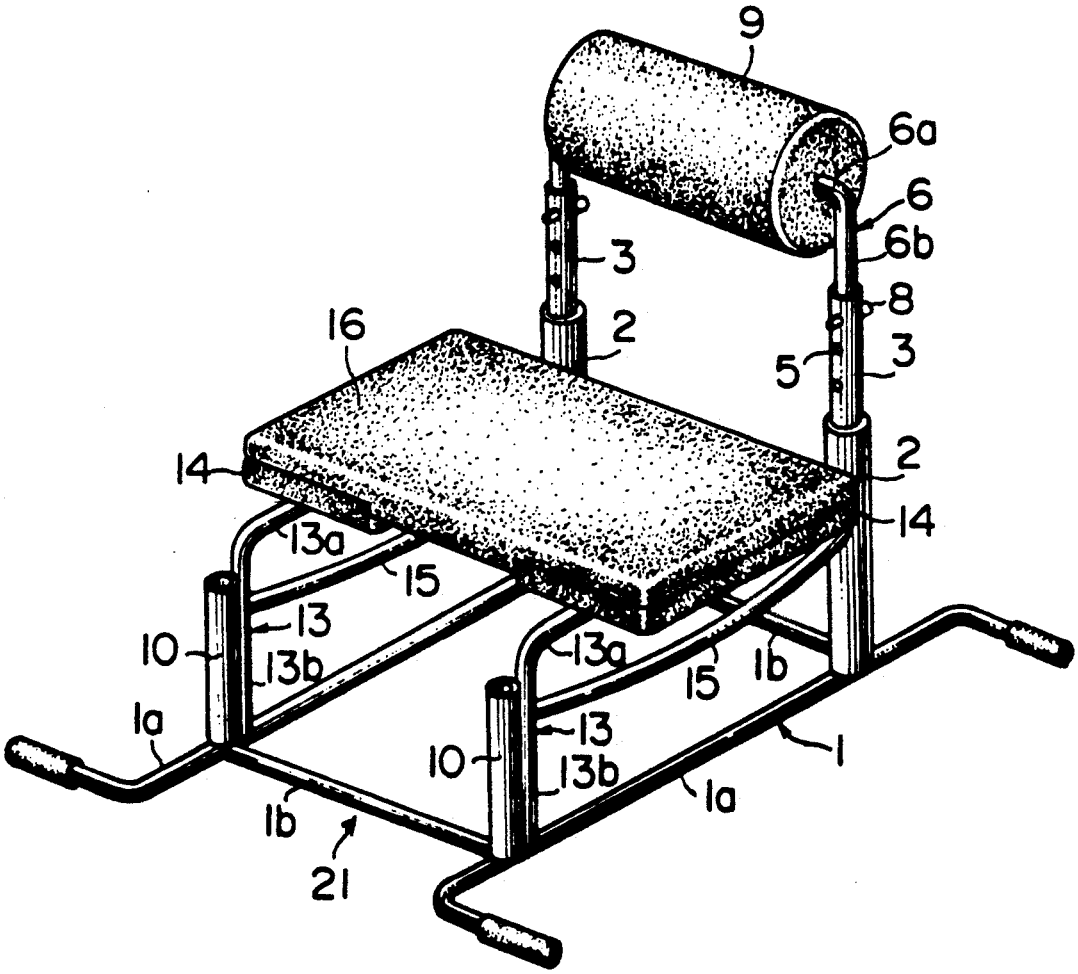
FIG. 8 is a perspective view of the apparatus of FIG. 1 configured for use as a chair.

Apparatus 20, as shown in FIG. 8, can be reconfigured into a chair by pulling the support member 11 out from the support pipes 10 and laying a chair cushion plate 16 across the shoulder rest members 14.

As described, the apparatus 20 can be fabricated to have a compact size. Also, since the user moves to an inverted position from a bending position by raising and stretching their legs, their head will not swing through a large circular arc in going to an inverted attitude, precluding the user from feeling ill. In addition, with their shoulders resting on the shoulder rest members 14, and the lower part of their body leaned against the support member 11, the user is stably supported in an inverted position with a minimal requirement for arm strength. Further, since the user is supported in an inverted position with their hips and legs stretched, blood flow to the user's brain is increased precluding the user from feeling cramped.

The invention in an apparatus for supporting a user in an inverted attitude has been described herein. It should, however, be understood that the preferred embodiment of the invention as described may be varied and changes made thereto without departing from the subject matter, and its spirit, coming within the scope of the following claims, and a reasonable equivalency thereof, which claims I regard as my invention.

I claim:

1. Apparatus for supporting a user in an inverted position comprising, interconnected foot members that provide flat support for surface engagement;

a pair of shoulder support members extending between abdomen rest member supports and support member upright members;

a pair of shoulder rest members that are parallel sections that are individually, horizontally mounted to each of said shoulder support members to be spaced apart so as to receive a user's shoulders rested thereon with the user's head inserted therebetween;

abdomen rest member supports extending upwardly at approximately right angles from each of said foot members;

an abdomen rest member mounted across said abdomen rest member supports at approximately at a right angle to the ends of said shoulder rest members, said abdomen rest member to receive the user abdomen region, thereon with their shoulders rested on said shoulder members, said abdomen rest member additionally being vertically movable and including a resilient bias means for biasing said abdomen rest member upwardly opposing the weight of a user's abdomen resting upon the abdomen rest member;

a pair of grip members each disposed below one of said shoulder rest members, for gripping by the user;

a pair of support member upright members extending upwardly at approximately right angles from each of said foot members;

a support member disposed across said support member upright members to be parallel to said abdomen rest member and arranged across the opposite ends of said shoulder rest members for receiving a lower portion of the user's body as they rotate to a shoulder stand attitude with their shoulders resting on said shoulder rest members.

2. The apparatus as set forth in claim 1, wherein the abdomen rest member includes a straight horizontal portion, and further includes a cylindrical abdomen cushion member that is axially mounted on said straight horizontal portion to be rotatable.

3. The apparatus as set forth in claim 2 wherein the abdomen rest member supports include a pair of columns, with the abdomen rest member telescoped in said columns to be vertically movable to provide for vertical positioning of the abdomen rest member.

4. The apparatus as set forth in claim 1, wherein the bias means are spring biasing means arranged with each abdomen rest member supports for opposing the weight of the user's abdomen rested upon the abdomen rest means; and means for adjusting the height of each said abdomen rest member support.

5. The apparatus as set forth in claim 1, wherein the support member includes a straight horizontal portion that is padded to receive and support a user's body.

6. The apparatus as set forth in claim 1, wherein the support member and pair of support member upright members are removable from said apparatus; and further including a rectangular seat for fitting across the top surfaces of the shoulder rests.

7. The apparatus as set forth in claim 1, wherein the front members, shoulder support members, abdomen rest member supports, grip members, and support member upright members and support member are all formed from individual steel pipes.

* * * * *